US011684178B1

(12) United States Patent
Rumfola, III et al.

(10) Patent No.: US 11,684,178 B1
(45) Date of Patent: Jun. 27, 2023

(54) RECONFIGURABLE INFANT SUPPORT STRUCTURE

(71) Applicant: Mattel, Inc., El Segundo, CA (US)

(72) Inventors: Ross Rumfola, III, Akron, NY (US); Maarten Van Huystee, Gasport, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 17/955,211

(22) Filed: Sep. 28, 2022

(51) Int. Cl.
*A47D 13/10* (2006.01)
*A47D 13/06* (2006.01)
*A47D 11/00* (2006.01)

(52) U.S. Cl.
CPC ..... *A47D 13/107* (2013.01); *A47D 11/00* (2013.01); *A47D 13/06* (2013.01)

(58) Field of Classification Search
CPC ..... A47D 11/00; A47D 13/107; A47D 13/06; A47D 13/061; A47D 13/063
See application file for complete search history.

(56) References Cited

U.S. PATENT DOCUMENTS 2,386,721 A 10/1945 Sedita
2,595,532 A 5/1952 Leitner
5,934,747 A * 8/1999 Garland ..... A47D 11/00 297/440.22
6,041,455 A * 3/2000 Raffo ..... A47D 13/063 5/98.1
8,341,781 B1 1/2013 Bleser
8,795,023 B2 8/2014 Elson
10,342,361 B2 7/2019 Cotirla et al.
10,463,170 B2 11/2019 Lange et al.
10,736,437 B2 8/2020 Goh et al.
10,835,054 B2 11/2020 Cotirla et al.
2016/0374481 A1 12/2016 Sclare et al.
2021/0361078 A1 11/2021 Logan

FOREIGN PATENT DOCUMENTS

FR 2900553 A1 * 11/2007 ..... A47D 13/063

* cited by examiner

*Primary Examiner* — Milton Nelson, Jr.
(74) *Attorney, Agent, or Firm* — Edell, Shapiro & Finnan, LLC

(57) ABSTRACT

An infant support structure may have multiple deployed configurations or orientations and a collapsed configuration or orientation. The infant support structure may include a support frame having a platform, a seat portion, and legs coupled to the platform. The infant support structure may also include a flexible material coupled to a support member that is engageable with each of the legs. In one deployed configuration or orientation, an infant can be placed in the seat portion. In another deployed configuration or orientation, an infant can be placed in a receptacle or play area formed by the flexible material. To facilitate transportation and storage, the infant support structure can be manipulated to a collapsed configuration.

20 Claims, 10 Drawing Sheets

RECONFIGURABLE INFANT SUPPORT STRUCTURE

TECHNICAL FIELD

The present disclosure is directed to an infant support structure that can be deployed in multiple configurations and orientations, which enables various use patterns for an infant.

BACKGROUND OF THE INVENTION

Various types of infant support structures exist that provide a parent or caregiver a structure that can be used to support an infant. Often, infant support structures typically only have one type of play pattern or use. For example, an infant support structure that includes a seat component that supports an infant in a seating orientation usually can only be used when the infant is in the seat component. Similarly, an infant support structure that has walls defining a receptacle in which an infant can be placed can be used to retain the infant in the receptacle. Each of these infant support structures requires space for use and storage. Parents who own multiple infant support structures often find themselves burdened by the cost of purchasing multiple infant support structures, which can be costly. In addition to the cost burdens, having to own multiple infant support structures also creates a space burden on parents and caregivers since each infant support structure takes up a significant amount of space within a home, even if it is capable of being placed in a storage configuration.

Therefore, what is needed is an infant support structure that provides a parent or caregiver alternative modes for supporting an infant, thereby providing the parent or caregiver with support options and a longer time that an infant can be supported and entertained by the single infant support structure.

SUMMARY OF THE INVENTION

The present disclosure is directed to an infant support structure that may include a support frame; a plurality of legs pivotably coupled to the support frame, each of the legs being movable between a deployed position and a collapsed position, the legs collectively supporting the support frame on a support surface when the legs are in their deployed positions, at least one of the legs includes a connector; a flexible material coupled to the support frame, the flexible material being disposable in a collapsed position and in an extended position, the flexible material forming a wall and defining a receptacle when the flexible material is in its extended position, the flexible material being substantially adjacent to the support frame when the flexible material is in its collapsed position; and a support member coupled to the flexible material, the support member being movable relative to the support frame, the support member including at least one connector coupled thereto, wherein each leg connector is engageable with one of the support member connectors, when the legs are in their deployed positions each leg connector is engaged with a support member connector thereby retaining the support member in a fixed position relative to the support frame, and when each leg connector is released from a corresponding support member connector, the legs are disengaged from the support member and the support member is movable relative to the support frame.

In alternative embodiments, the infant support structure may include various features. For example, the flexible material may limit the extent to which the support member can be moved away from the support frame. Also, the infant support structure may have a first deployed configuration and a second deployed configuration. The infant support structure may also have a first orientation relative to a support surface in the first deployed configuration and a second orientation relative to a support surface in the second deployed configuration, the second orientation being upside down relative to a support surface as compared to the first orientation. The infant support structure may receive and support an infant when the infant support structure is in its first orientation and when the infant support structure is in its second orientation.

In one embodiment, each leg has a first end and a second end opposite the first end of the leg, each leg being pivotally coupled to the support frame proximate to the first end of the leg, each leg includes a release mechanism coupled to its leg connector, the release mechanism being manipulable to decouple the corresponding leg connector from the corresponding support member connector. In addition or alternatively, each release mechanism includes a knob biased to a locking position and a latch biased to a locking position, and movement of the knob of each release mechanism from its locking position moves the latch of that release mechanism from its locking position, thereby decoupling the corresponding leg connector from the corresponding support member connector and allowing the corresponding leg to be pivoted from its deployed position to its collapsed position.

In another embodiment, the infant support structure may have a first deployed configuration and a second deployed configuration, and the legs extend upwardly from the support frame in the first deployed configuration, and the legs extend downwardly from the support frame in the second deployed configuration. In addition, the support frame includes a perimeter and a center, each leg pivots relative to the support frame from its deployed position in either of the first deployed configuration and the second deployed configuration to its collapsed position, and the pivoting of each leg being inwardly from the support frame perimeter toward the support frame center. Alternatively or in addition, the support frame may have an upper surface and a lower surface, the support frame includes a plurality of support posts proximate to the upper surface, the legs being proximate to the lower surface, the support posts configured to engage a support surface when the support frame is in a first orientation, and the legs configured to engage a support surface when the support frame is in a second orientation opposite to the first orientation.

According to one embodiment, the infant support structure presented herein may include having a first deployed configuration and a second deployed configuration, and have a support frame with a seat portion configured to receive an infant when the infant support structure is in its first deployed configuration; a plurality of legs pivotably coupled to the support frame, the legs collectively supporting the support frame on a support surface when the legs are deployed and the infant support structure is in its first deployed configuration; a mesh material coupled to the support frame, the mesh material being movable between an extended position and a collapsed position; and a substantially circular member coupled to the mesh material, the substantially circular member including at least one connector coupled thereto, wherein each connector is engageable with one of the legs when the legs are deployed to thereby couple the substantially circular member to the one of the legs, the mesh material being in its extended position when the substantially circular member is coupled to at least one of the legs, the mesh material in its extended position defining a receptacle in which an infant can be placed when the infant support structure is in its second deployed configuration.

In an alternative embodiment, the mesh material limits the extent to which the substantially circular member can be moved away from the support frame. The infant support structure may have a first orientation relative to a support surface in the first deployed configuration, the seat portion being accessible in the first deployed configuration, and the infant support structure has a second orientation relative to a support surface in the second deployed configuration, the second orientation being upside down relative to a support surface as compared to the first orientation, and the mesh material receptacle being accessible in the second deployed configuration. Each leg may have a first end and a second end opposite the first end of the leg, each leg being pivotally coupled to the support frame proximate to the first end of the leg, each leg includes a release mechanism coupled to its leg connector, the release mechanism being manipulable to decouple the corresponding leg connector from the corresponding support member connector. Each release mechanism may include a knob biased to a locking position and a latch biased to a locking position, and movement of the knob of each release mechanism from its locking position moves the latch of that release mechanism from its locking position, thereby decoupling the corresponding leg connector from the corresponding support member connector and allowing the corresponding leg to be pivoted from its deployed position to its collapsed position.

According to another embodiment, the infant support structure presented herein may include a support frame having a perimeter and a center; a plurality of legs pivotably coupled to the support frame proximate to the perimeter of the support frame, each leg being movable between a deployed position and a collapsed position in which the leg is pivoted toward the center, the legs collectively supporting the support frame on a support surface when the legs are in their deployed positions, each leg including a spring-biased latch mechanism and a spring-biased release mechanism coupled to the spring-biased latch mechanism; a flexible material coupled to the support frame, the flexible material forming a wall and defining a receptacle when the flexible material is in an extended position relative to the support frame, the flexible material in its entirety being adjacent to the support frame when the flexible material is in a collapsed position relative to the support frame; and a support member coupled to the flexible material, wherein each latch mechanism engages the support member to retain the support member in a distal position spaced apart from the support frame, the flexible material being in its extended position and defining the receptacle when the support member is retained in its distal position, and each spring-biased release mechanism is actuatable to move a corresponding spring-biased latch mechanism to decouple the corresponding leg from the support member, thereby allowing the flexible material to collapse and the legs to pivot to positions proximate to the support frame.

In other embodiments, the infant support structure presented herein may include each leg having a first end and a second end opposite the first end of the leg, each leg being pivotally coupled to the support frame proximate to the first end of the leg and movable so that the second end of the leg is proximate to a center of the support frame. Each spring-biased release mechanism includes a knob biased to a locking position, the spring-biased latch mechanism is biased to a locking position, and movement of each knob away from its locking position moves the corresponding spring-biased latch mechanism from its locking position, thereby decoupling the corresponding leg from the support member. The support frame has an upper surface and a lower surface, the support frame includes a plurality of support posts proximate to the upper surface, the legs being proximate to the lower surface, the support posts configured to engage a support surface when the support frame is in a first orientation, and the legs configured to engage a support surface when the support frame is in a second orientation opposite to the first orientation. The flexible material is located between the support frame and the legs when the legs are in their collapsed positions.

Other systems, apparatuses, methods, features, and advantages will be, or will become, apparent to one with skill in the art upon examination of the following figures and detailed description. All such additional systems, apparatuses, methods, features, and advantages are included within this description, are within the scope of the claimed subject matter.

BRIEF DESCRIPTION OF THE DRAWINGS

The infant support structure presented herein may be better understood with reference to the following drawings and description. It should be understood that some elements in the figures may not necessarily be to scale and that emphasis has been placed upon illustrating the principles disclosed herein. In the figures, like-referenced numerals designate corresponding parts throughout the different views.

DETAILED DESCRIPTION OF THE INVENTION

An infant support structure may have multiple deployed configurations or orientations and a collapsed configuration or orientation. The infant support structure may include a support frame having a platform, a seat portion, and legs coupled to the platform. The infant support structure may also include a flexible material coupled to a support member that is engageable with each of the legs. In one deployed configuration or orientation, an infant can be placed in the seat portion. In another deployed configuration or orientation, an infant can be placed in a receptacle or play area formed by the flexible material. To facilitate transportation and storage, the infant support structure can be manipulated to a collapsed configuration.

Figure 1:
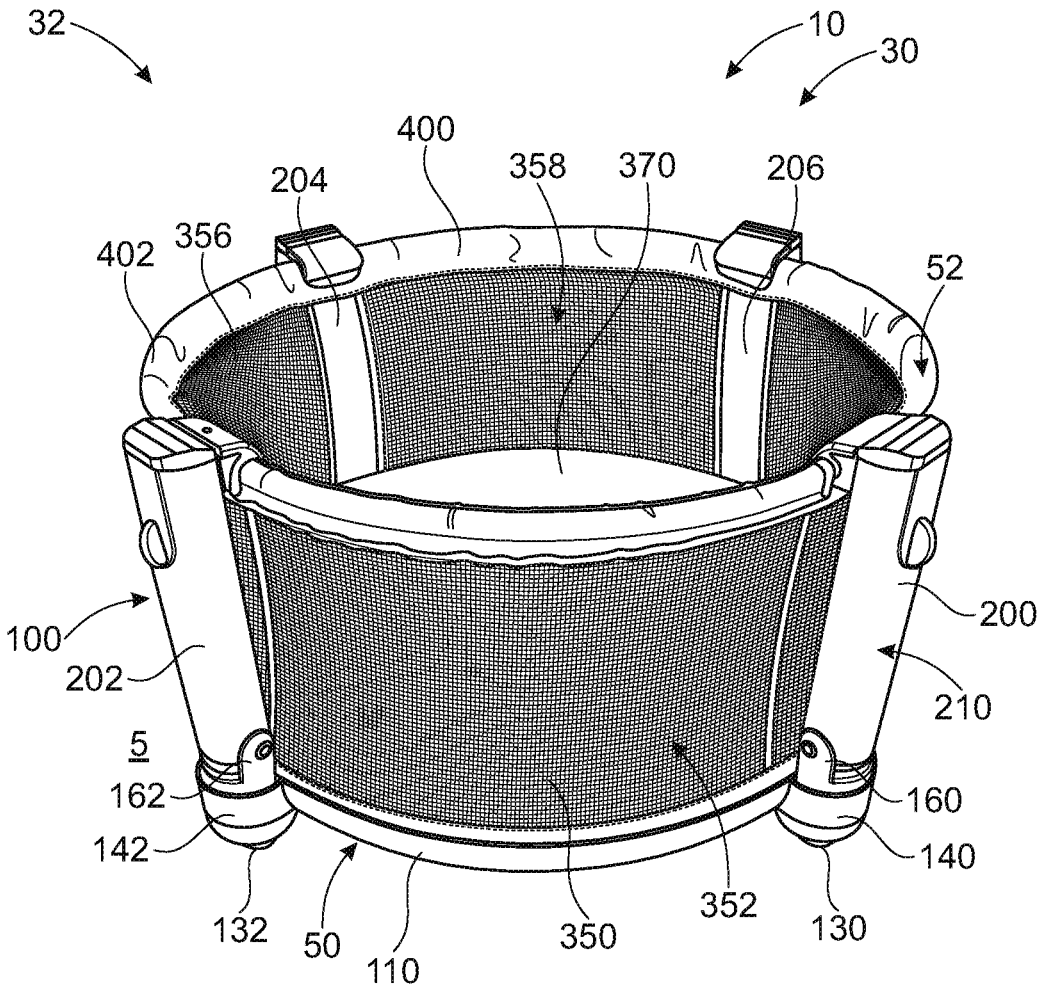
FIG. 1 illustrates a perspective view of an infant support structure in a deployed configuration in accordance with an example embodiment of the present disclosure.

Referring to FIG. 1, a perspective view of an exemplary embodiment of an infant support structure is illustrated. In this embodiment, the infant support structure 10 is illustrated in a deployed configuration 30, which is a configuration useable with early stage infant development. This configuration 30 can be referred to as a bassinet mode for the infant support structure 10.

As shown, the infant support structure 10 includes a support frame 100 that can be used to support an infant (not shown). In this configuration 30, the infant support structure 10 is in a first orientation 32 relative to the support surface 5. The infant support structure 10 has a first end 50 and an opposite second end 52. In this orientation 32, the first end 50 can be referred to as a lower end relative to the support surface 5, and the second end 52 can be referred to as an upper end relative to the support surface 5.

In this orientation 32, several support posts formed on the infant support structure 10 engage the support surface 5 (only support posts or nubs 130 and 132 are illustrated in FIG. 1). The nubs provide clean support points with respect to support surface 5 because they are the only points of contact for the infant support structure 10 and the support surface 5 in this orientation 32. No other objects or parts of the infant support structure 10 engage the support surface 5 to provide support. In addition, the nubs do not roll and therefore provide a relatively stationary support on the support surface 5.

The infant support structure 10 includes a platform 110 and several legs 200, 202, 204, and 206 that are coupled to the platform 110. The legs are illustrated in their deployed positions in FIG. 1. Legs 200 and 202 are pivotally coupled to fixed leg portions 160 and 162, respectively, that extend from flanges 140 and 142, respectively. While not shown in FIG. 1, legs 204 and 206 are also pivotally coupled to fixed leg portions, respectively. The pivoting connection of each leg is accomplished by a connector, such as a bolt, that defines an axis about which the corresponding leg pivots.

The infant support structure 10 also includes a flexible material 350 that is coupled at one end proximate to the platform 110. In one embodiment, the flexible material 350 is a mesh or fabric material through which any object within the area surrounded by the flexible material 350 can be seen. Referring to FIG. 1, the flexible material 350 is illustrated in its extended position 352, which in orientation 32 has the flexible material 350 extending upwardly from the platform 110.

The support frame 100 also includes a support member 400 that is movable relative to the platform 110. The support member 400 can be referred to alternatively as a substantially circular member in this embodiment. The support member 400 is coupled to the flexible material 350 by being inserted into a hem or channel formed in the flexible material 350. In one embodiment, the coupling of the support member 400 and the flexible material 350 is at an end of the flexible material 350 opposite to where the flexible material 350 is coupled proximate to the platform 110.

The support member 400 is retained in the illustrated fixed or distal position 402 in which it is spaced apart from the platform 110. In this position 402, the support member 400 holds the flexible material 350 away from the platform 110 such that the flexible material 350 forms a wall 356 that defines a receptacle or play area 358 in which an infant can be placed. This receptacle 358 is a bassinet-like area. In one embodiment, a removable pad 370 is placed inside the receptacle 358 on the lower surface of the platform 110. The removable pad 370 provides a cushioned, soft surface on which an infant can be placed.

As shown in FIG. 1, and also shown in later FIGS and described below, the support member 400 is removably coupleable to each of the legs 200, 202, 204, and 206, which retains the support member 400 in the illustrated position 402.

Figure 2:
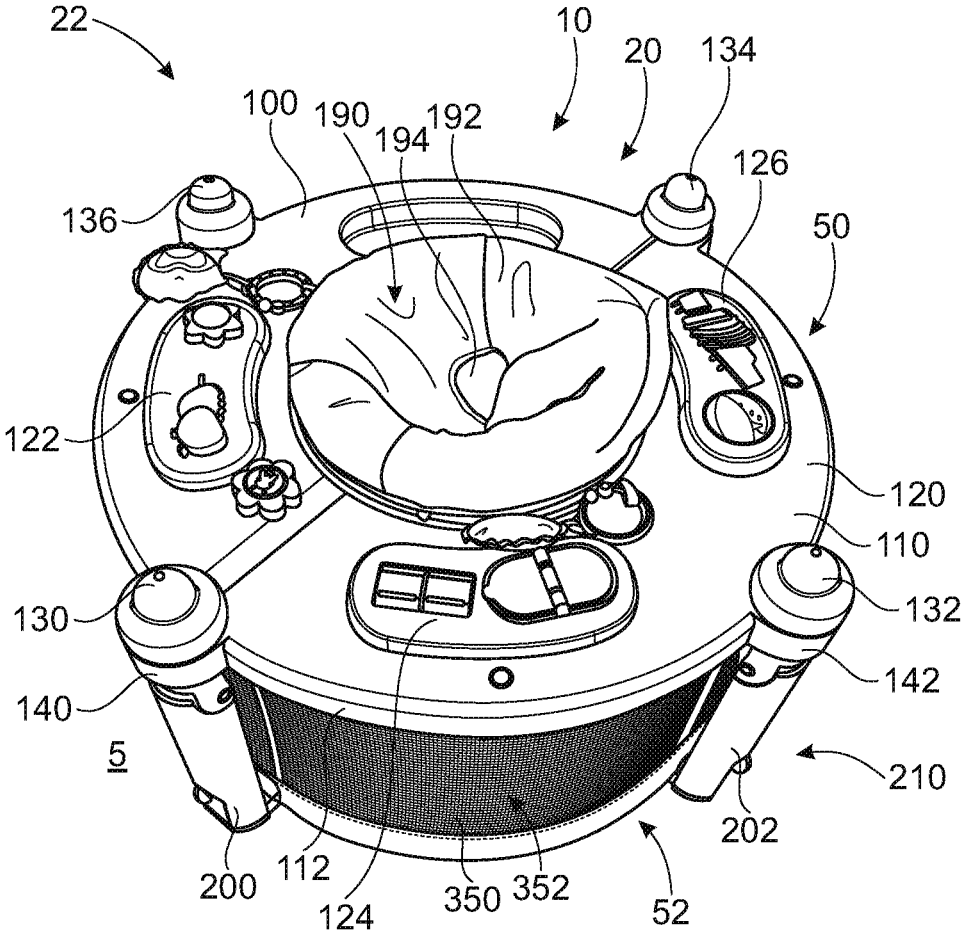
FIG. 2 illustrates a perspective view of the infant support structure illustrated in FIG. 1 in another deployed configuration.

Referring to FIG. 2, the infant support structure 10 is illustrated in another deployed configuration 20 on a support surface 5, which is different than deployed configuration 30 in FIG. 1. In this configuration 20, infant support structure 10 is shown in a different orientation 22, and the infant support structure 10 is upside down relative to the orientation 32 in FIG. 1. First end 50 is now an upper end, and second end 52 is now a lower end. In the orientation 22 illustrated in FIG. 2, the infant support structure 10 is useable with later stage infant development than the orientation 32 illustrated in FIG. 1. In this orientation 22, the infant support structure 10 can be referred to as being an entertainment mode, particularly in view of an infant accessing the platform 110.

In this orientation 22, the infant support structure 10 can support an infant in a seating position. The platform 110 of the support frame 100 of the infant support structure 10 rotatably supports a seat portion 190 for an infant. In this embodiment, the seat portion 190 includes a flexible seat 192 that has two openings 194 for the legs of an infant.

The platform 110 has an upper surface 120 in this orientation 22 that has several toy components or areas 122, 124, and 126 that can be fixedly or removably coupled to the platform 110. The toy components 122, 124, and 126 are spaced apart on upper surface 120 such that the infant in the seat 192 can access different toy components as the infant and the seat 192 rotate relative to the platform 110.

As referenced above, the support frame 100 includes several legs that are coupled to the platform 110 to position the platform 110 above the support surface 5. While only legs 200 and 202 are visible in FIG. 2, the other legs of the support frame can be seen in other FIGS. 1*n* FIG. 2, each of the legs 200 and 202 is in its deployed position 210 relative to the platform 110. The legs 200 and 202 are pivotally mounted and repositionable relative to the platform 110 as described in greater detail below.

In this embodiment, the platform 110 has a perimeter 112 from which several flanges extend outwardly. In FIG. 2, flanges 140 and 142 are illustrated and are located proximate to the connections with legs 200 and 202, respectively. Two similarly spaced flanges are located on the other side of the platform perimeter 112. Proximate to each of the flanges is one of the support posts or nubs 130, 132, 134, and 136.

Each of the support posts 130, 132, 134, and 136 extends upwardly in this orientation 22. When the infant support structure 10 is manipulated to its orientation illustrated in FIG. 1, the support posts or nubs 130, 132, 134, and 136 protect the upper surface 120 and the toy components 122, 124, and 126.

Figure 3:
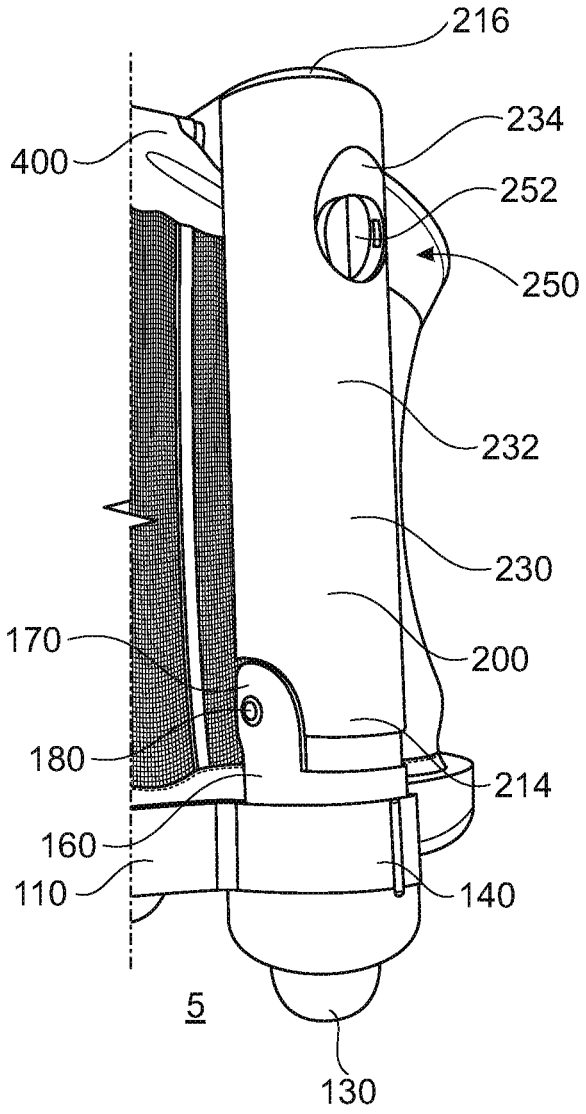
FIG. 3 illustrates a side view of a leg of the infant support structure illustrated in FIG. 1.

Referring to FIG. 3, a close-up view of one of the legs of the infant support structure 10 is illustrated. While leg 200 is illustrated in FIG. 3 and described below, the same features and functionality applies to each of the other legs 202, 204, and 206. As shown, leg 200 is pivotally coupled to the two flanges 170 opposite each other that extend from fixed leg portion 160. The connection is made by connector or bolt 180 that enables leg 200 to pivot relative to platform 110.

The support post 130 that extends from flange 140 is shown as engaging support surface 5. The support posts 130, 132, 134, and 136 provide four points of contact that prevent objects on the upper surface 120 of the platform 110 from being points of contact with the support surface 5. This arrangement eliminates the potential damage to the upper surface 120 of the platform 110.

Leg 200 has a first end 214 pivotally coupled to flanges 170 and an opposite second end 216 that engages the support surface 5 when the infant support structure 10 is in the orientation 22 illustrated in FIG. 2. The leg 200 has an outer housing 230 with an outer surface 232 in which a recess 234 is formed. Leg 200 includes a locking mechanism, described in detail later, and a release mechanism 250. The locking mechanism can be used to couple the leg 200 to the support member 400, and the release mechanism 250 can be used to decouple the leg 200 from the support member 400. In this embodiment, the release mechanism 250 is located in the recess 234 of the leg 200.

Figure 4:
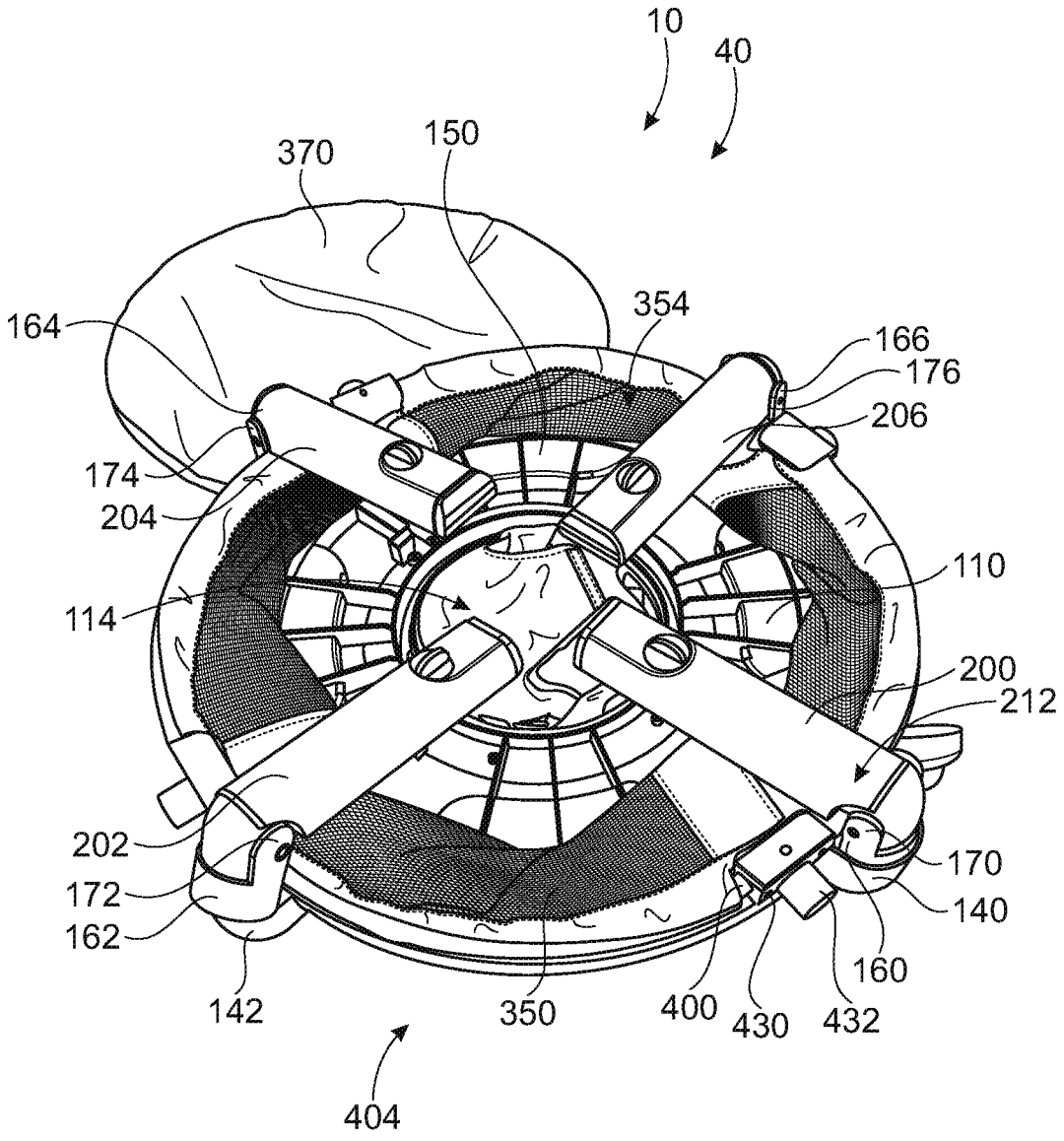
FIG. 4 illustrates a perspective view of the infant support structure illustrated in FIG. 1 in a collapsed configuration.

Referring to FIG. 4, the infant support structure 10 is illustrated in a collapsed configuration 40. In this configuration, the support member 400 has been decoupled from each of the legs 200, 202, 204, and 206, and moved proximate the lower surface 150 of the platform 110. Once the support member 400 has been decoupled, it is slightly rotated by the user or caregiver and the legs 200, 202, 204, and 206 can be folded down to their collapsed positions 212. In these positions 212, the legs 200, 202, 204, and 206 pivot about the respective pair of flanges 170, 172, 174, and 176, and extend from the respective fixed leg portions 160, 162, 164, and 166 proximate to the perimeter of the platform 110 radially inward toward the center 114 of the platform 110. Each of the legs 200, 202, 204, and 206 is independently movable relative to the other of the legs.

In FIG. 4, the pad 370 has been removed from the infant support structure 10, thereby facilitating the collapsing of the support frame 100. When the support member 400 is moved to its collapsed position 404, the flexible member 350 is in its collapsed position 354, in which it is close to the support frame 110 as well.

The support member 400 has four connectors coupled thereto, each of which is engageable with one of the legs 200, 202, 204, and 206 to couple the support member 400 to the legs. As shown in FIG. 4, support member 400 includes a housing 430 that has an extension or coupler 432 that is a connector or coupler that engages leg 200. The support member 400 has three other similar housings with extensions to engage the other three legs 202, 204, and 206. The details relating to the collapsing of the infant support structure 10 is illustrated in and described with respect to FIGS. 5-13.

Figure 5:
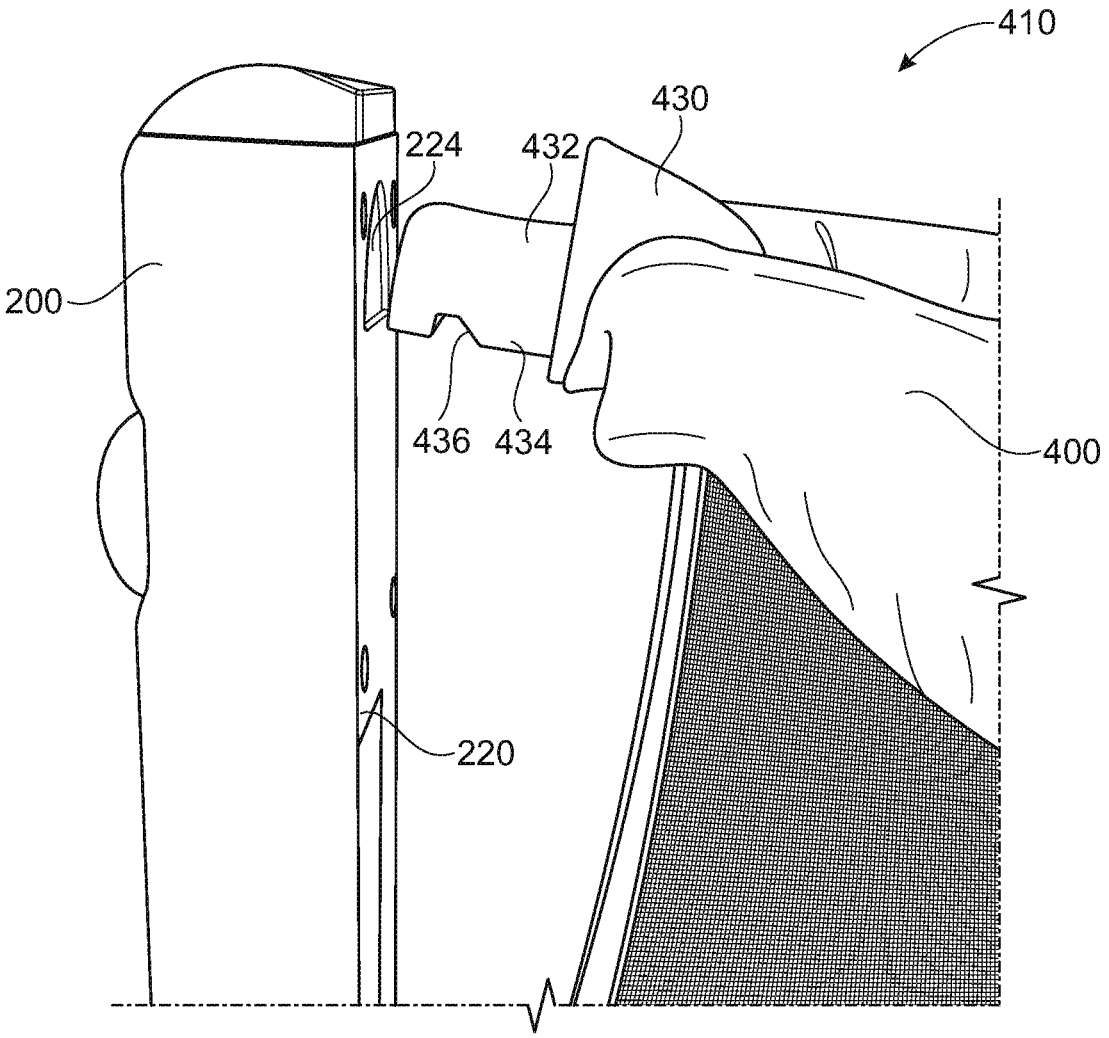
FIG. 5 illustrates a side view of components of the infant support structure illustrated in FIG. 1, with a leg being decoupled from a support member.

Turning FIG. 5, a close-up view of leg 200 and one of the connectors 410 on support member 400 is illustrated. As shown, leg 200 has an inner housing 220 in which a receptacle 224 is defined or formed. The receptacle 224 is sized and configured to receive extension 432 of housing 430 of connector 410. Extension 432 has a surface 434 in which a recess or groove 436 is formed.

Figure 6:
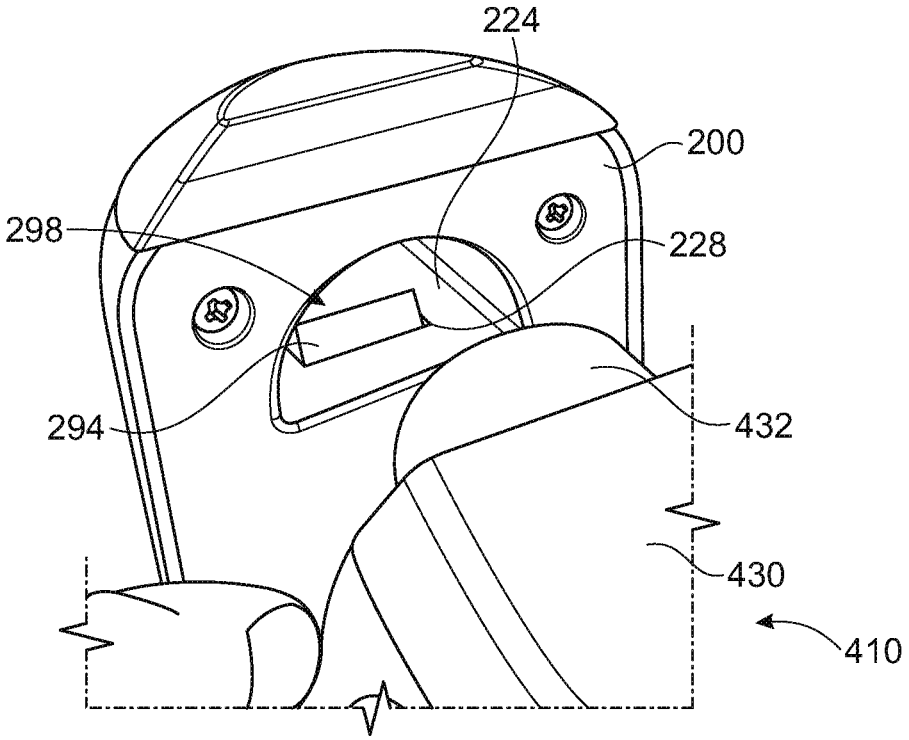
FIG. 6 illustrates a close-up perspective view of the leg illustrated in FIG. 5 with a locking tab in a locking position.
Figure 7:
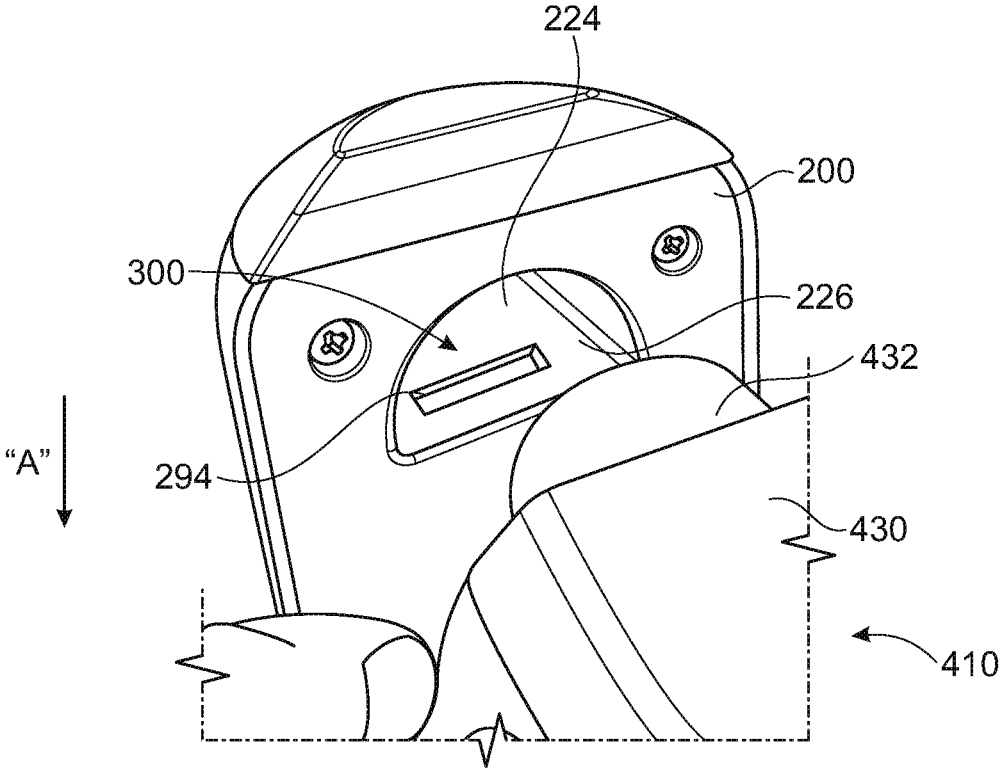
FIG. 7 illustrates a close-up perspective view of the leg illustrated in FIG. 5 with the locking tab in an unlocking position.

Turning to FIGS. 6 and 7, close-up perspective views of part of the leg 200 and connector 410 are illustrated. In each of those FIGS., the housing 430 and extension 432 of connector 410 are shown. The receptacle 224 in inner housing 220 is defined in part by surface 226. Surface 226 includes an opening 228 formed therein through which a locking tab portion or member 294 extends. Referring to FIG. 6, the locking member 294 is in its extended or locking position 298 in which the locking member 294 extends through the opening 228 and into the receptacle 224. In this position 298, the locking member 294 engages with groove 436 in extension 432 when the extension 432 is inserted into the receptacle 224. When locking member 294 is in groove 436, the extension 432 is coupled to the leg 200 and the support member 400 is retained in its distal position 402.

As described in more detail below, the locking member 294 is biased by a biasing member, such as a spring, into its locking position 298. The locking member 294 can be moved along the direction of arrow "A" to its retracted or unlocking position 300 in which the locking member 294 does not extend upwardly and outwardly from the opening 228. When the locking member 294 is retracted, the extension 432 of connector 410 can be removed from receptacle 224 and the support member 400 is movable toward the support frame 110 to its collapsed position.

Figure 8:
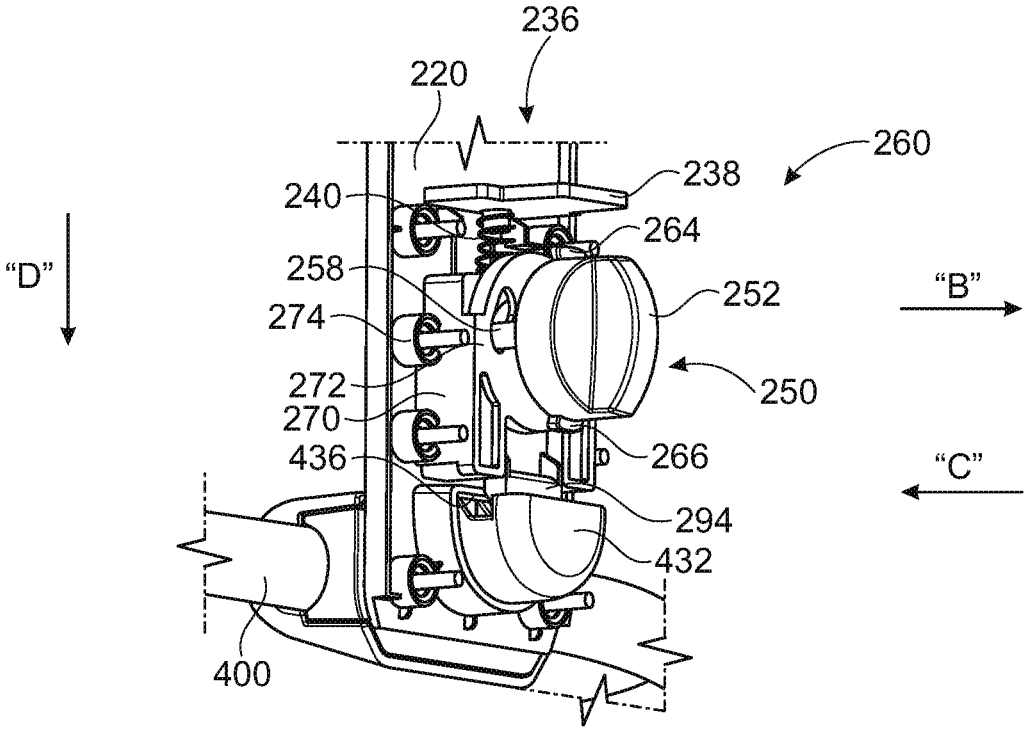
FIG. 8 illustrates a perspective view of some components of the locking mechanism of the infant support structure illustrated in FIG. 1.
Figure 9:
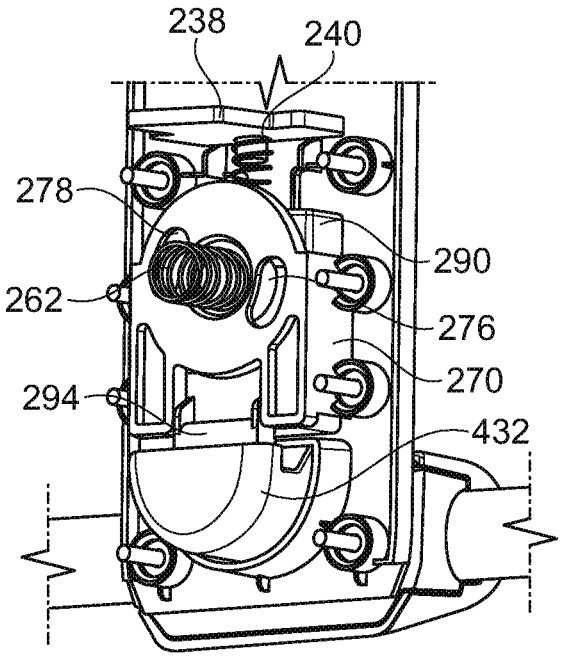
FIG. 9 illustrates a perspective view of some components of the locking mechanism illustrated in FIG. 8.

Referring to FIGS. 8 and 9, perspective views of come of the components of leg 200 of infant support structure 10 are illustrated. In particular, the release and locking mechanism 250 of the leg 200 are shown. The outer housing 230 of leg 200 has been removed and the components located in the cavity 236 between the outer housing 230 and the inner housing 220. A plate 238 is mounted between the housings 220 and 230 and a biasing member 240, such as a spring, is engaged with the plate 238.

A latch or latch mechanism 290 is slidably mounted in cavity 236. The latch 290 can be referred to alternatively as a slider leg lock. The latch 290 is mounted for movement along the longitudinal axis of the leg 220. At one end of the latch 290 is the tab or locking member 294 described above relative to FIG. 5, and now shown in FIGS. 8 and 9 as engaging slot 436 of extension 432. The movement of the latch 290 is defined in part by a guide or retainer 270 that has a body 272 and several flanges 274 through which connectors pass to couple the guide 270 to one or both of the leg housings 220 and 230. Guide 270 does not move relative to the leg housings 220 and 230.

The release and locking mechanism 250 includes an actuator or knob 252 that can be manipulated by a user to release or undo the connection between the leg 200 and the support member 400. The actuator 252 is biased along the direction of arrow "B" by spring 262 and retained in the orientation shown in FIG. 8 by a pair of tabs 264 and 266 formed on opposite sides of the actuator 252 that engage detents or notches formed on the leg housing 230. To rotate the actuator 252 about its center axis, a user pushes the actuator 252 along the direction of arrow "C" to compress the spring 262. By pushing inwardly on actuator 252, the tabs 264 and 266 disengage from the detents or notches on the leg housing 230, thereby allowing the actuator 252 to be rotated.

Figure 14:
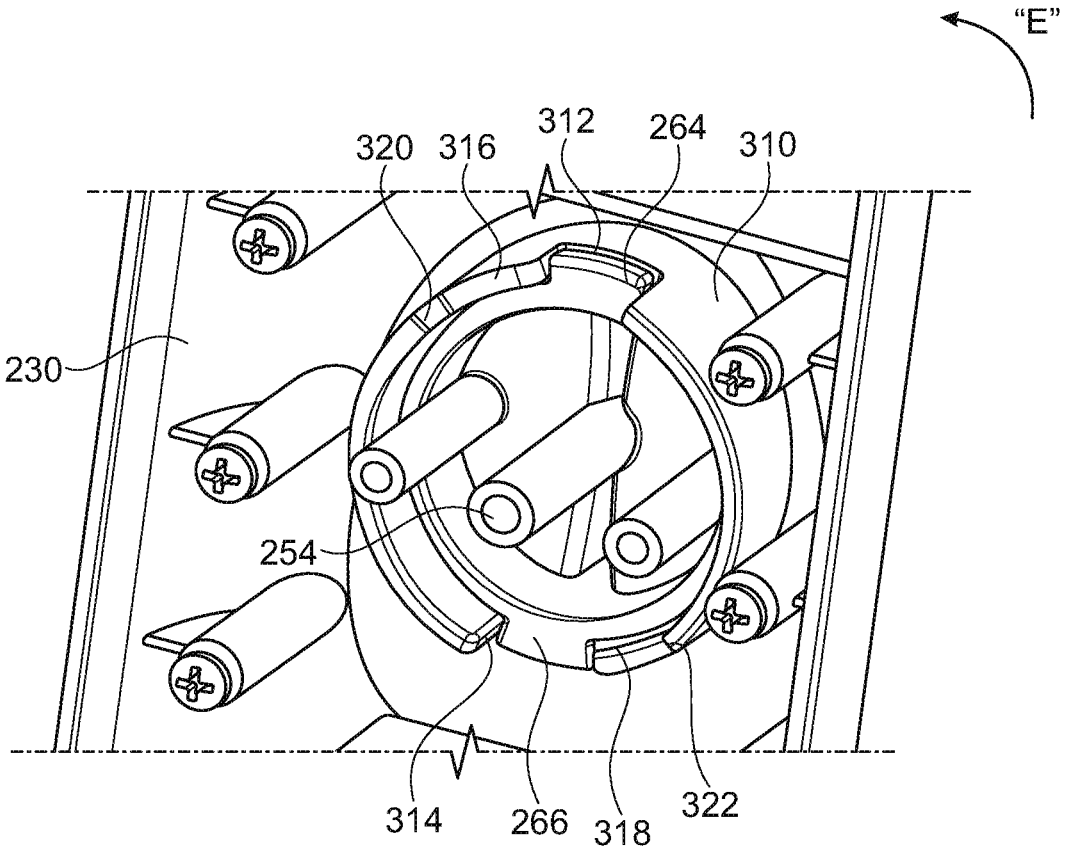
FIG. 14 illustrates a perspective view of some components of the locking mechanism illustrated in FIG. 8.

Referring to FIG. 14, the engagement of tabs 264 and 266 with detents or notches is illustrated. As shown, leg housing 230 includes a mount 310 that is configured to receive the actuator 252. The mount 310 is circular and sized to permit rotation of the actuator 252 relative to the leg housing 320. The mount 310 has opposing locking notches 312 and 314 that are sized to receive the tabs 264 and 266 of the actuator 252 when the spring 262 biased the actuator 252 into its locking position. The engagement of tabs 264 and 266 with locking notches 312 and 314 prevents actuator 252 from rotating.

When a user pushes inwardly on actuator 252, tabs 264 and 266 disengage from locking notches 312 and 314, thereby allowing rotation of the actuator 252 along the direction of arrow "E" about center post 254. As the actuator 252 rotates in that direction, tabs 264 and 266 engage unlocking notches 316 and 318, respectively, and abut stops 320 and 322, respectively. The movement of actuator 252 to its unlocking position in which its tabs 264 and 266 are engaged with unlocking notches 316 and 318 and stops 320 and 322, results in the movement of the locking member 294 and the decoupling of leg 320 from the connector 410 of support member 400. The actuator 252 is retained in this unlocked position by tabs 264 and 266 and notches 316 and 318 until the user rotates the actuator along the direction opposite to arrow "E". Rotation of actuator 252 in the opposite direction to arrow "E" causes the tabs 264 and 266 to engage locking notches 312 and 314, respectively, once again.

Referring back to FIGS. 8-9 and 11-13, the guide 270 includes a pair of slots 276 and 278 and a center opening 280. The actuator 252 has center post 254 and a pair of side posts 256 and 258, each of which extends from the rear surface of the actuator 252. The center post 254 of the actuator 252 engages the center opening 280 of the guide 270, and defines the axis of rotation of the actuator 252. Each of the side posts 256 and 258 of the actuator 252 engages one of the slots 276 and 278 of the guide 270, which are arcuate and sized to permit side posts 256 and 258 to travel therealong as the actuator 252 is rotated. The lengths of the slots 276 and 278 limit the amount of rotation of the actuator 252.

Figure 10:
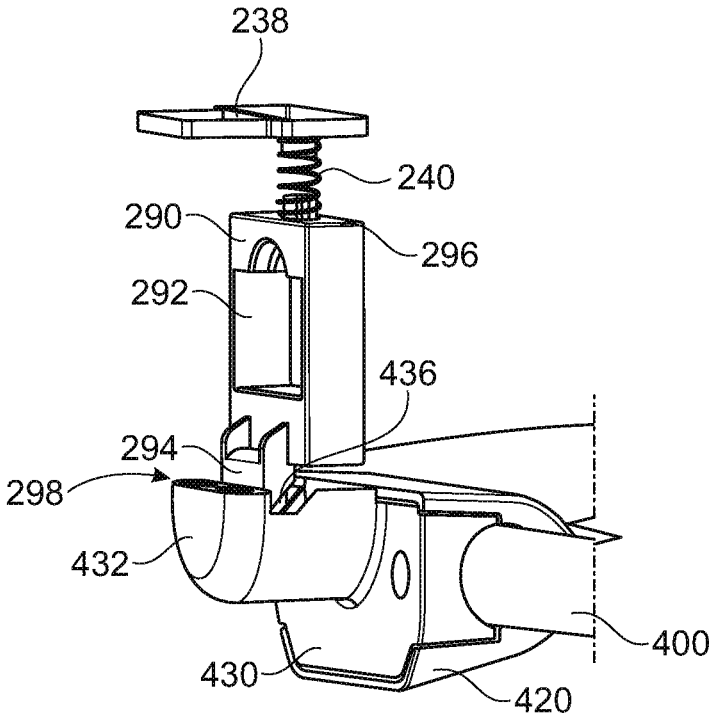
FIG. 10 illustrates a perspective view of some components of the locking mechanism illustrated in FIG. 8.

Referring to FIG. 10, additional details of the latch 290 are illustrated. In this embodiment, the latch 290 has a body with an inner surface 295 that defines a central opening 292. The central opening 292 is sized to allow the interaction between the actuator 252 and the latch 290. The latch body has an upper surface 296 that is engaged by spring 240 to bias the latch 290 and its locking member 294 into a locking position 298 in which it engages groove 436 of extension 432. As shown, the connector 410 includes a housing 420 coupled to housing 430 that has the extension 432 that engages with leg 200. The housings 420 and 430 are located on opposite sides of the support member 400 and coupled together.

Figure 11:
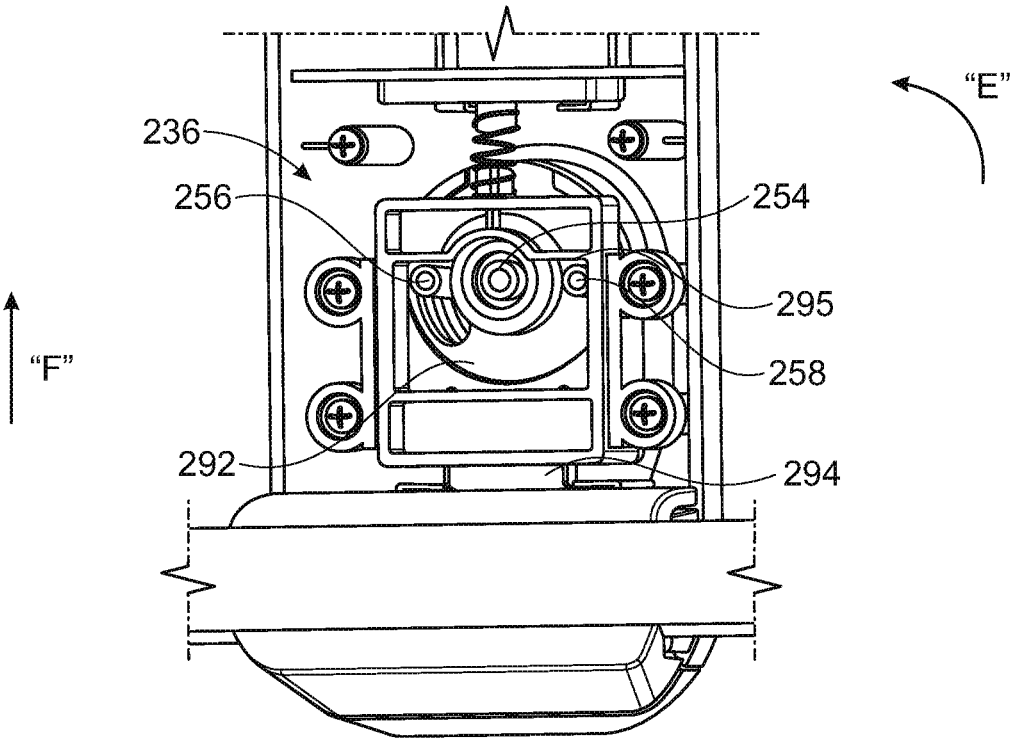
FIG. 11 illustrates a perspective view of some components of the locking mechanism illustrated in FIG. 8.
Figure 12:
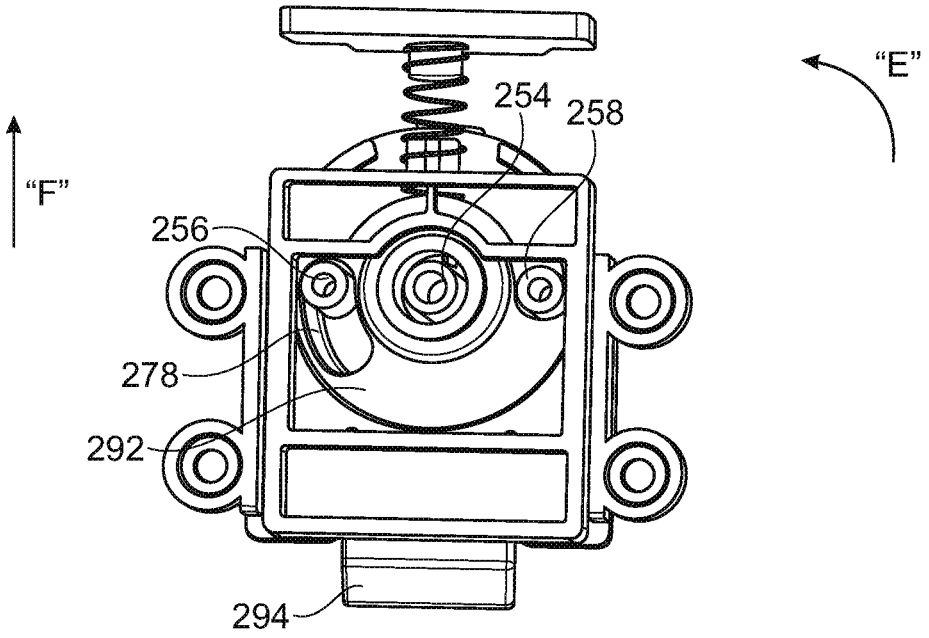
FIG. 12 illustrates a plan view of some components of the locking mechanism illustrated in FIG. 8.
Figure 13:
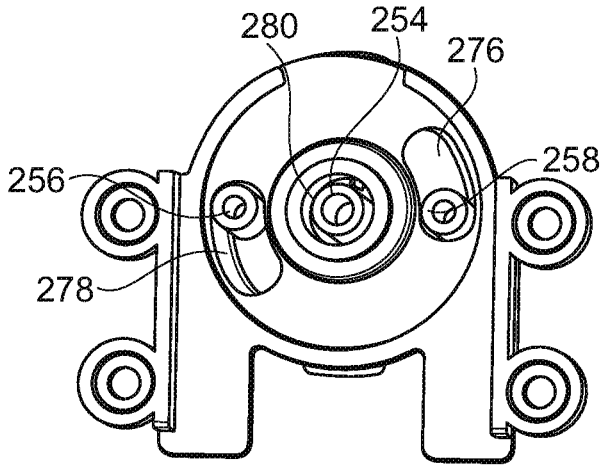
FIG. 13 illustrates a plan view of some components of the locking mechanism illustrated in FIG. 8.

Referring to FIGS. 11-13, the operation of the release and locking mechanism 250 to unlock leg 200 from support member 400 is shown and described. To disengage actuator 252 from leg housing 230, the actuator 252 is pushed inwardly against the bias force from spring 262 to disengage from the locking notches 312 and 314 in leg housing 230. The actuator 252 is held inwardly against spring 262 and rotated about center post 254 in guide opening 280 along the direction of arrow "E" in FIG. 11. As actuator 252 rotates, side posts 256 and 258 rotate in slots 276 and 278, respectively. Side post 256 moves downwardly in slot 276. Side post 258 moves upwardly in slot 278 and engages the inner surface 295 of latch 290, which moves the latch 290 upwardly along the direction of arrow "F". Movement of the latch 290 in that direction compresses the spring 240 and moves the locking member 294 to its unlocking position 300 and out of engagement from the groove 436 of extension 432. As a result, the extension 432 can be removed from receptacle 224, thereby decoupling the support member 400 from leg 200. Once the extension 432 has been removed, the actuator 252 can be rotated back to its locking position 260 (see FIG. 8) and released by the user. Once released, the actuator 252 is biased by spring 262 into its locking position 260 and the tabs 264 and 266 engage the detents or locking notches 312 and 314 on leg housing 230.

After each of the connectors 410 on the support member 400 have been decoupled or disconnected from the legs 200, 202, 204, and 206, the support member 400 and the flexible material 350 coupled thereto can be placed proximate to the platform 110. After the support member 400 is slightly rotated to move the connectors 410 to positions offset from the legs 200, 202, 204, and 206, the legs can be folded from their deployed positions (see FIGS. 1 and 2) to their collapsed positions (see FIG. 4). The folding of the legs next to the platform 110 gives the infant support structure 10 a slim profile that facilitates traveling and storing of the structure 10.

To reconfigure the infant support structure 10 from its collapsed configuration to one of its deployed configurations, the legs 200, 202, 204, and 206 are pivoted from their collapsed positions to their deployed positions, the support member 400 is lifted away from the platform 110, and each of the connectors 410 on the support member 400 is coupled to a corresponding one of the legs 200, 202, 204, and 206. Once the support member 400 is secured to all of the legs 200, 202, 204, and 206, the user can place the infant support structure 10 in either its deployed configuration 20 that provides access to a seat, or its deployed configuration 30 that provides access to a receptacle or play area.

In the foregoing detailed description, reference is made to the accompanying figures which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the foregoing detailed description is not to be taken in a limiting sense, and the scope of embodiments is defined by the appended claims and their equivalents.

Aspects of the disclosure are disclosed in the description herein. Alternate embodiments of the present disclosure and their equivalents may be devised without parting from the spirit or scope of the present disclosure. It should be noted that any discussion herein regarding "one embodiment", "an embodiment", "an exemplary embodiment", or a similar phrase indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

While the apparatuses and methods presented herein have been illustrated and described in detail and with reference to specific embodiments thereof, it is nevertheless not intended to be limited to the details shown, since it will be apparent that various modifications and structural changes may be made therein without departing from the scope of the inventions and within the scope and range of equivalents of the claims. For example, the infant support structures/apparatuses presented herein may be modified to contain any number of upstanding frame members, seat supports, interactive assemblies, interactive components, interactive elements, etc. Moreover, the infant support structures/apparatuses presented herein may be modified to resemble any other structure, device, etc.

In addition, various features from one of the embodiments may be incorporated into another of the embodiments. That is, it is believed that the disclosure set forth above may encompass multiple distinct inventions with independent utility. While each of these inventions has been disclosed in a preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions, and/or properties disclosed herein. Accordingly, it is appropriate that the appended claims be construed broadly and in a manner consistent with the scope of the disclosure as set forth in the following claims.

It is also to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention. Additionally, it is also to be understood that the infant support structures/apparatuses described herein, and any portions thereof, may be fabricated from any suitable material or combination of materials, such as plastic, metals, composites, etc., as well as derivatives thereof, and combinations thereof.

The terms "comprising," "including," "having," and the like, as used with respect to embodiments of the present disclosure, are synonymous. When used herein, the term "comprises" and its derivations (such as "comprising", etc.) should not be understood in an excluding sense, that is, these terms should not be interpreted as excluding the possibility that what is described and defined may include further elements, steps, etc. Similarly, where any description recites "a" or "a first" element or the equivalent thereof, such disclosure should be understood to include incorporation of one or more such elements, neither requiring nor excluding two or more such elements. Meanwhile, when used herein, the term "approximately" and terms of its family (such as "approximate", etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about", "around", "generally", and "substantially."

What is claimed is:

1. An infant support structure, comprising:

a support frame including a platform, the support frame comprising:

a plurality of legs pivotably coupled to the platform of the support frame, each of the legs being movable between a deployed position and a collapsed position, the legs collectively supporting the support frame on a support surface when the legs are in their deployed positions, at least one of the legs includes a connector;

a flexible material coupled to the platform of the support frame, the flexible material being disposable in a collapsed position and in an extended position, the flexible material forming a wall and defining a receptacle when the flexible material is in its extended position, the flexible material being substantially adjacent to the platform of the support frame when the flexible material is in its collapsed position; and a support member coupled to the flexible material, the support member being movable relative to the platform of the support frame, the support member including at least one connector coupled thereto, wherein each leg connector is engageable with one of the support member connectors, when the legs are in their deployed positions each leg connector is engaged with a support member connector thereby retaining the support member in a fixed position relative to the support frame, and when each leg connector is released from a corresponding support member connector, the legs are disengaged from the support member and the support member is movable relative to the platform of the support frame.

2. The infant support structure of claim 1, wherein the flexible material limits the extent to which the support member can be moved away from the platform of the support frame.

3. The infant support structure of claim 1, wherein the infant support structure has a first deployed configuration and a second deployed configuration.

4. The infant support structure of claim 3, wherein the infant support structure has a first orientation relative to a support surface in the first deployed configuration and a second orientation relative to a support surface in the second deployed configuration, the second orientation being upside down relative to a support surface as compared to the first orientation.

5. The infant support structure of claim 4, wherein the infant support structure can receive and support an infant when the infant support structure is in its first orientation and when the infant support structure is in its second orientation.

6. The infant support structure of claim 1, wherein each leg has a first end and a second end opposite the first end of the leg, each leg being pivotally coupled to the platform of the support frame proximate to the first end of the leg, each leg includes a release mechanism coupled to its leg connector, the release mechanism being manipulable to decouple the corresponding leg connector from the corresponding support member connector.

7. The infant support structure of claim 6, wherein each release mechanism includes a knob biased to a locking position and a latch biased to a locking position, and movement of the knob of each release mechanism from its locking position moves the latch of that release mechanism from its locking position, thereby decoupling the corresponding leg connector from the corresponding support member connector and allowing the corresponding leg to be pivoted from its deployed position to its collapsed position.

8. The infant support structure of claim 1, wherein the infant support structure has a first deployed configuration and a second deployed configuration, and the legs extend upwardly from the support frame in the first deployed configuration, and the legs extend downwardly from the support frame in the second deployed configuration.

9. The infant support structure of claim 8, wherein the support frame includes a perimeter and a center, each leg pivots relative to the platform of the support frame from its deployed position in either of the first deployed configuration and the second deployed configuration to its collapsed position, and the pivoting of each leg being inwardly from the support frame perimeter toward the support frame center.

10. The infant support structure of claim 1, wherein the platform of the support frame has an upper surface and a lower surface, the support frame includes a plurality of support posts proximate to the upper surface, the legs being proximate to the lower surface, the support posts configured to engage a support surface when the support frame is in a first orientation, and the legs configured to engage a support surface when the support frame is in a second orientation opposite to the first orientation.

11. An infant support structure having a first deployed configuration and a second deployed configuration, comprising:

a support frame with a seat portion configured to receive an infant when the infant support structure is in its first deployed configuration, the support frame including a platform, the support frame comprising:

a plurality of legs pivotably coupled to the platform of the support frame, the legs collectively supporting the support frame on a support surface when the legs are deployed and the infant support structure is in its first deployed configuration;

a mesh material coupled to the platform of the support frame, the mesh material being movable between an extended position and a collapsed position; and a substantially circular member coupled to the mesh material, the substantially circular member including at least one connector coupled thereto, wherein each connector is engageable with one of the legs when the legs are deployed to thereby couple the substantially circular member to the one of the legs, the mesh material being in its extended position when the substantially circular member is coupled to at least one of the legs, the mesh material in its extended position defining a receptacle in which an infant can be placed when the infant support structure is in its second deployed configuration.

12. The infant support structure of claim 11, wherein the mesh material limits the extent to which the substantially circular member can be moved away from the platform of the support frame.

13. The infant support structure of claim 11, wherein the infant support structure has a first orientation relative to a support surface in the first deployed configuration, the seat portion being accessible in the first deployed configuration, and the infant support structure has a second orientation relative to a support surface in the second deployed configuration, the second orientation being upside down relative to a support surface as compared to the first orientation, and the mesh material receptacle being accessible in the second deployed configuration.

14. The infant support structure of claim 13, wherein each leg has a first end and a second end opposite the first end of the leg, each leg being pivotally coupled to the platform of the support frame proximate to the first end of the leg, each leg includes a release mechanism coupled to its leg connector, the release mechanism being manipulable to decouple the corresponding leg connector from the corresponding support member connector.

15. The infant support structure of claim 14, wherein each release mechanism includes a knob biased to a locking position and a latch biased to a locking position, and movement of the knob of each release mechanism from its locking position moves the latch of that release mechanism from its locking position, thereby decoupling the corresponding leg connector from the corresponding support member connector and allowing the corresponding leg to be pivoted from its deployed position to its collapsed position.

16. An infant support structure, comprising:

a support frame having a platform with a perimeter and a center, the support frame comprising:

a plurality of legs pivotably coupled to the platform of the support frame proximate to the perimeter of the platform of the support frame, each leg being movable between a deployed position and a collapsed position in which the leg is pivoted toward the center, the legs collectively supporting the support frame on a support surface when the legs are in their deployed positions, each leg including a spring-biased latch mechanism and a spring-biased release mechanism coupled to the spring-biased latch mechanism;

a flexible material coupled to the platform of the support frame, the flexible material forming a wall and defining a receptacle when the flexible material is in an extended position relative to the platform of the support frame, the flexible material in its entirety being adjacent to the support frame when the flexible material is in a collapsed position relative to the platform of the support frame; and a support member coupled to the flexible material, wherein each latch mechanism engages the support member to retain the support member in a distal position spaced apart from the platform of the support frame, the flexible material being in its extended position and defining the receptacle when the support member is retained in its distal position, and each spring-biased release mechanism is actuatable to move a corresponding spring-biased latch mechanism to decouple the corresponding leg from the support member, thereby allowing the flexible material to collapse and the legs to pivot to positions proximate to the platform of the support frame.

17. The infant support structure of claim 16, wherein each leg has a first end and a second end opposite the first end of the leg, each leg being pivotally coupled to the platform of the support frame proximate to the first end of the leg and movable so that the second end of the leg is proximate to the center of the platform of the support frame.

18. The infant support structure of claim 16, wherein each spring-biased release mechanism includes a knob biased to a locking position, the spring-biased latch mechanism is biased to a locking position, and movement of each knob away from its locking position moves the corresponding spring-biased latch mechanism from its locking position, thereby decoupling the corresponding leg from the support member.

19. The infant support structure of claim 16, wherein the support frame has an upper surface and a lower surface, the support frame includes a plurality of support posts proximate to the upper surface, the legs being proximate to the lower surface, the support posts configured to engage a support surface when the support frame is in a first orientation, and the legs configured to engage a support surface when the support frame is in a second orientation opposite to the first orientation.

20. The infant support structure of claim 19, wherein the flexible material is located between the platform of the support frame and the legs when the legs are in their collapsed positions.

* * * * *